US006430388B1

(12) United States Patent
Hirai et al.

(10) Patent No.: US 6,430,388 B1
(45) Date of Patent: Aug. 6, 2002

(54) IMAGE FORMING MACHINE HAVING FINISHER FOR DIFFERENT LENGTH SHEETS

(75) Inventors: Yasuyuki Hirai; Hiroshi Kusumoto; Kiyonori Yamamoto; Yukio Hashimoto, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/525,426

(22) Filed: Mar. 14, 2000

(30) Foreign Application Priority Data

Apr. 23, 1999 (JP) ..... 11-116016

(51) Int. Cl.[7] ..... G03G 15/00
(52) U.S. Cl. ..... 399/401; 399/407
(58) Field of Search ..... 399/401, 402, 399/407, 408, 410, 363, 364

(56) References Cited

U.S. PATENT DOCUMENTS 4,652,112 A * 3/1987 Randall ..... 399/402
5,216,474 A * 6/1993 Nakao ..... 399/402
5,253,030 A * 10/1993 Shigemura et al. ..... 399/407
5,398,918 A * 3/1995 Rizzolo et al. ..... 270/58.08
5,594,542 A * 1/1997 Sugimoto et al. ..... 399/402
5,926,684 A * 7/1999 Horiuchi et al. ..... 399/402

* cited by examiner

*Primary Examiner*—Robert Beatty
(74) *Attorney, Agent, or Firm*—Smith, Gambrell & Russell, LLP

(57) ABSTRACT

An image forming machine having a reversing transport path in which a transport direction of a sheet introduced from an image forming transport path is reversed, a returning path in which the sheet reversely transported from the reversing transport path is returned below the image forming transport path with the directions of the face and back of the sheet being unchanged, and an inverting transport path in which the sheet from the returning path is turned upside down and readmitted into an upstream portion of the image forming transport path. A finisher including a sheet receiving stand placed below the returning path is provided, and at least one send-in unit for selectively sending in different length sheets onto the sheet receiving stand is disposed in the returning path.

2 Claims, 5 Drawing Sheets

IMAGE FORMING MACHINE HAVING FINISHER FOR DIFFERENT LENGTH SHEETS

FIELD OF THE INVENTION

This invention relates to an image forming machine such as laser printer, facsimile, or electrostatic copier. More specifically, the invention relates to an image forming machine which can form images on both surfaces of a sheet, and by which the sheet having an image or images formed on one or both of its surfaces can be discharged after posttreatment of the sheet, such as punching, stapling, or sorting.

DESCRIPTION OF THE PRIOR ART

In an image forming machine, such as an electrostatic copier (hereinafter referred to as a copier), there may be need to not only discharge a sheet having an image formed thereon (a copied sheet) onto a copy receiving tray, but also perform sheet posttreatment, such as punching, stapling, or sorting. In this case, a finisher (a sheet post-treating device) is produced independently of the copier, and is provided detachably on a lateral side part of the copier.

In a copier, the height of a sheet discharge port differs generally depending on the entire size of the copier. When the copier is equipped with a finisher, it has been common practice to produce a specific finisher, which has a sheet send-in port with a height corresponding to the sheet discharge port of a copier of a specific size (type), and provide the copier of the specific size with the specific finisher.

There has been known a finisher, which is to be provided on a copier, and which has a punching means installed at an upstream position of a sheet send-in path, the punching means designed for punching as sheet posttreatment. With this type of finisher, a sheet having an image formed thereon is once stopped when it passes through the punching means. At the time of its stoppage, punching is performed for an end portion of the sheet. More concretely, the punching means has a sheet stopper. The sheet stopper is disposed so as to be selectively brought by a drive means, such as cam, to a retreat position at which the sheet stopper retreats from a sheet send-in path, and permits transport of the sheet sent in, and a stop position at which the sheet stopper protrudes into the sheet send-in path to block the sheet send-in path, and contacts one end of the sheet sent in, i.e., its downstream end in a transport direction of the sheet, to stop the movement of the sheet temporarily, thereby putting the sheet to a predetermined punched position. When the sheet stopper is located at the stop position with a predetermined timing with respect to the sending-in of the sheet, the sheet sent in is stopped at the punched position. Then, a punch of the punching means is reciprocated in a face-and-back direction of the sheet to carry out punching at a predetermined position of an end portion of the sheet, the downstream end portion of the sheet. The sheet punched at its one end portion is sent in, in a state turned upside down, onto a sheet receiving stand provided at the finisher. A pile of the punched sheets thus stored on the sheet receiving stand is discharged onto a discharge tray for sorting.

The above-described finisher having the punching means may be provided in a copier capable of forming images on both surfaces of a sheet. An example of this type of copier has an image forming transport path in which an image is formed on one surface of the sheet being transported, a reversing transport path in which a transport direction of the sheet selectively introduced from a downstream portion of the image forming transport path is reversed, a returning path in which the sheet reversely transported from the reversing transport path is returned below the image forming transport path with the directions of the face and back of the sheet being unchanged, and an inverting transport path in which the sheet returned through the returning path is turned upside down and readmitted into an upstream portion of the image forming transport path. The downstream end of the image forming transport path is connected to the sheet send-in path of the finisher provided on the copier. When the sheet having images formed on both surfaces thereof in the copier is to be punched, the sheet is sent in from the downstream end of the image forming transport path to the sheet send-in path of the finisher, and has its end portion is punched in the aforementioned manner.

As described above, the finisher provided on the copier is produced to be adapted for a specific copier. When it is installed actually, adjustment of its height is an essential task. Particularly in an unfavorable environment for installation, such as a place of installation with a slope or irregularities, this height adjusting work involves considerable labor and burden, thus taking a long time for installation. If, after installation of the finisher, a deviation in height occurs between the finisher and the copier, or a deviation arises in the gap between them, because of unexpected factors, transport of the sheet from the copier to the finisher may fail to be performed stably. In case the sheet is not stably transported, a jam may take place, or a defective product may occur. Since the finisher is installed at a side portion of the copier, moreover, a lateral surplus space for installation is needed. Furthermore, in dealing with the jam, it is necessary to separate the finisher from the copier laterally. Thus, the above lateral space will have to be expanded further.

In a copier capable of image formation on both surfaces of a sheet and provided with a finisher having punching means, when punching is to be performed in an end portion of a sheet having an image formed only on one surface thereof during its transport through an image forming transport path of the copier, the sheet is fed into the finisher from a downstream end of the image forming transport path. The end portion of the sheet sent into the finisher is brought into contact with the sheet stopper of the punching means located at the stop position, and stopped at the punched position. Then, punching is carried out at a predetermined position of the end portion of the sheet. When punching is to be performed in an end, portion of a sheet having images formed on both surfaces thereof, the sheet having an image formed on one surface thereof during its transport through the image forming transport path of the copier passes through the reversing transport path and the returning path. Then, the sheet is turned upside down in the inverting transport path, and readmitted into an upstream portion of the image forming transport path. During its re-transport through the image forming transport path, an image is formed on the other surface of the sheet. The sheet having images formed on both surfaces thereof is sent into the finisher from a downstream end of the image forming transport path, and punching is performed at a predetermined position of an end portion of the sheet by the punching means in the manner stated earlier.

As clear from the foregoing description, the distance of transport during which the sheet has images formed on both surfaces thereof in the copier, then enters the finisher, and contacts the sheet stopper of the punching means is about twice or more as long as the distance of transport during which the sheet has an image formed on only one surface thereof, then enters the finisher, and contacts the sheet stopper of the punching means. Furthermore, transport of the sheet in double-sided image formation involves the inverting action of the sheet. As the sheet transport distance increases, there is a high possibility that displacement of the sheet in a horizontal direction perpendicular to the direction of transport (hereinafter referred to as "transport width direction") will increase during transport of the sheet. If the inverting action is involved during transport of the sheet, this possibility will be increased further. Consequently, the sheet having images formed on both surfaces thereof is transported over such a long distance of transport with its inverting motion being involved, and is brought into contact with the sheet stopper of the punching means in the finisher, whereby the sheet is stopped at the predetermined punched position. In this state, the possibility increases that displacement of the sheet in the transport width direction will become greater than in the sheet having an image formed on one surface thereof. This makes it difficult to bring the sheet to the predetermined punched position accurately, thus increasing variations, in the transport width direction, in the punch positions of a plurality of sheets that have been punched. As a result, a set of the punched plural sheets having images formed on both surfaces thereof and piled one on another suffer from a trouble, called hole misalignment, in which the punched holes of the sheets fail to align with a desired high accuracy. Thus, stable accuracy and quality of punching may fail to be ensured.

SUMMARY OF THE INVENTION

An object of the present invention is to provide a novel image forming machine which can perform posttreatment of a sheet without the need to produce a finisher independently and install it thereon, and thus does not require conventional finisher installation work, including a height adjustment task, and further achieves a space saving.

Another object of the invention is to provide a novel image forming machine which can transport a sheet stably while ensuring a sheet post-treating function, thereby reliably preventing a jam or the occurrence of a defective product.

Still another object of the invention is to provide a novel image forming machine which can use a sheet returning path concurrently as a send-in path to a sheet receiving stand to omit an independent send-in path to the sheet receiving stand, thus simplifying the structure of the machine and reducing costs.

A further object of the invention is to provide a novel image forming machine which can punch a plurality of types of sheets having images formed on both surfaces thereof, and pile the sheets to make a set of sheets having holes aligned with a desired high accuracy, thereby reliably preventing hole misalignment, so that stable accuracy and quality of punching can be ensured.

According to an aspect of the invention, there is provided an image forming machine having an image forming transport path in which an image is formed on one surface of a sheet being transported, a reversing transport path in which a transport direction of the sheet selectively introduced from a downstream portion of the image forming transport path is reversed, a returning path in which the sheet reversely transported from the reversing transport path is returned below the image forming transport path with the directions of the face and back of the sheet being unchanged, and an inverting transport path in which the sheet returned through the returning path is turned upside down and readmitted into an upstream portion of the image forming transport path, wherein:

a finisher including a sheet receiving stand placed below the returning path is provided, and at least one send-in means for selectively sending in the sheet, returned through the returning path, onto the sheet receiving stand is disposed in the returning path.

Preferably, a discharge path for discharging the sheet, which has been transported through the image forming transport path, onto a non-sorting discharge tray is disposed at a downstream end of the image forming transport path, a four-forked passageway is disposed at a downstream position of the image forming transport path, and a guide means is disposed on the four-forked passageway, the guide means being capable of selectively guiding the sheet, which has been transported through the image forming transport path, toward the discharge path, or the reversing transport path, or the returning path, and also selectively guiding the sheet, which has been introduced into the reversing transport path, toward the returning path.

Preferably, a plurality of return roller pairs are disposed in the returning path with spacing in a direction of returning, and the send-in means is composed of one of the return roller pairs, and a movable guide means which is disposed downstream from the one of the return roller pairs and which is selectively brought to a first guide position at which the movable guide means guides the sheet, returned by the one of the return roller pairs, toward the inverting transport path along the returning path, and a second guide position at which the movable guide means guides the sheet, returned by the one of the return roller pairs, toward the sheet receiving stand.

Preferably, a sorting discharge tray is disposed in a direction of extension of the sheet receiving stand, and the finisher has a catching means capable of catching an end of the sheet selectively sent in onto the sheet receiving stand by the send-in means and storing the sheet, and a sheet moving means capable of moving the sheet caught by the catching means toward the sorting discharge tray.

Preferably, the send-in means are disposed in the returning path at a plurality of positions corresponding to a plurality of types of sheets with different lengths in the direction of transport so that the plurality of types of sheets with different lengths in the direction of transport may be selectively returned, and the sheets may be selectively sent in toward the sheet receiving stand from the plurality of positions.

Preferably, a sheet post-treating means is placed in the other end portion of the sheet receiving stand, and a catching position of the catching means is put to a posttreatment position at which posttreatment by the sheet post-treating means is performed.

Preferably, the send-in means is disposed in the returning path at one position in one end portion of the sheet receiving stand facing the sorting discharge tray so that a plurality of types of sheets with different lengths in the direction of transport may be selectively returned, and the plurality of types of sheets with different lengths in the direction of transport may be selectively sent in from the one position, and the catching means is selectively moved to a plurality of catching positions, relative to the send-in means, corresponding to the plurality of types of sheets with different lengths in the direction of transport.

Preferably, a sheet post-treating means is placed in the other end portion of the sheet receiving stand, a catching position of the catching means corresponding to a sheet having a maximum length in the direction of transport is put to a posttreatment position at which posttreatment by the sheet post-treating means is performed, a catching position of the catching means corresponding to a sheet having a shorter length in the direction of transport than the maximum length in the direction of transport is set to be a predetermined catching position on the sheet receiving stand spaced by a predetermined distance from the posttreatment position toward the sorting discharge tray, and the sheets stored at the predetermined catching position by the catching means are moved to the posttreatment position by the sheet moving means to undergo posttreatment by the sheet post-treating means.

Preferably, a punching means is disposed at a downstream position in the image forming transport path.

According to another aspect of the invention, there is provided an image forming machine having an image forming transport path in which an image is formed on one surface of a sheet being transported, a reversing transport path in which a transport direction of the sheet selectively introduced from a downstream portion of the image forming transport path is reversed, and an inverting transport path in which the sheet transported through the reversing transport path is turned upside down and readmitted into an upstream portion of the image forming transport path, wherein:

a punching means is disposed at a downstream position in the image forming transport path.

BRIEF DESCRIPTION OF THE DRAWINGS

FIG .1 is a schematic sectional view showing main constituent elements of an embodiment of an electrostatic copier constructed in accordance with the present invention.

DETAILED DESCRIPTION OF THE PREFERRED EMBODIMENTS

Preferred embodiments of an image forming machine constructed in accordance with the present invention will now be described in detail with reference to the accompanying drawings.

Figure 1:
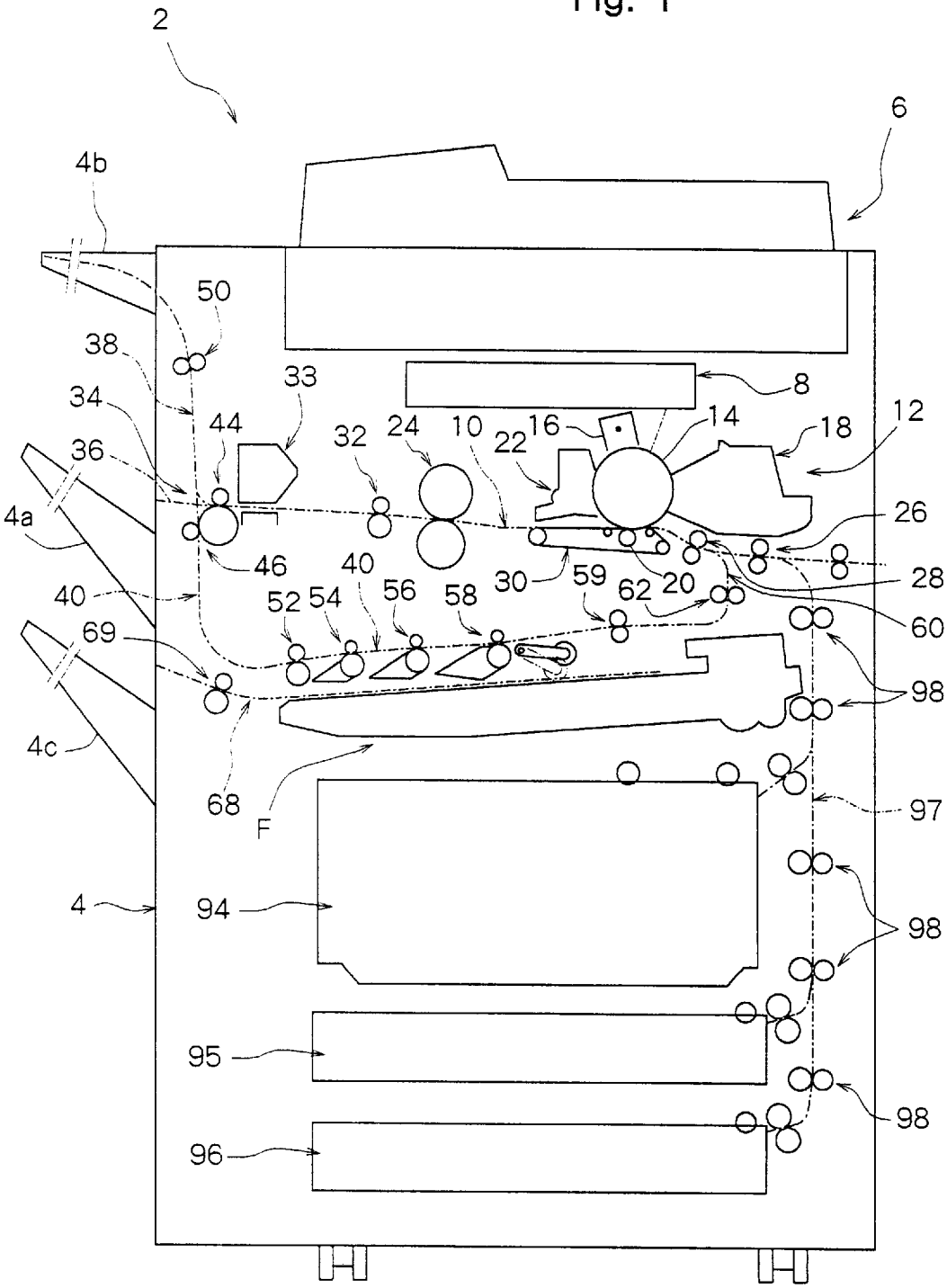

By reference to FIG. 1, the reference numeral 2 denotes a copier, an image forming machine. The copier 2 is provided with a copier body 4, a rectangular parallelopipedal body of the image forming machine. At an uppermost position of the copier body 4, a document transporting reader 6 including a document feeder is placed. At a position in the copier body 4 below the document transporting reader 6, a laser light scanning means 8 is disposed.

At a position in the copier body 4 below the laser light scanning means 8, an image forming transport path 10 extending in the lateral direction of the copier 2 (the right-and-left direction in FIG. 1) is placed. In connection with the image forming transport path 10, an image forming means 12 is disposed. The image forming means 12 has a photoconductor drum 14, and imaging elements disposed around the photoconductor drum 14, such as a main charger 16, a developing device 18, a transfer roller 20, a cleaner 22, and a static eliminator (not shown). The image forming means 12 also has a fixing device 24 placed at a position in the image forming transport path 10 downstream from the photoconductor drum 14. At a position in the image forming transport path 10 upstream from the photoconductor drum 14 (a right-hand position in FIG. 1), a transport roller pair 26 and a register roller pair 28 are placed in this order in the direction of transport. At a position in the image forming transport path 10 corresponding to the photoconductor drum 14, a carrier belt mechanism 30 is placed. The transport roller 20 is placed opposite an outer peripheral surface of the photoconductor drum 14, with a carrier belt included in the carrier belt mechanism 30 being sandwiched between the transport roller 20 and the outer peripheral surface of the photoconductor drum 14. At a position in the image forming transport path 10 downstream from the fixing device 24, a transport roller pair 32 is placed.

The document transporting reader 6 reads an image of each of a predetermined number of documents during their movement, and stores the images as image information. The image information stored in the document transporting reader 6 is projected by the laser light scanning means 8 onto the surface of the photoconductor drum 14 uniformly charged by the main charger 16. As a result, an electrostatic latent image is formed on the surface of the photoconductor drum 14. This electrostatic latent image is developed by the developing device 18. A sheet transported by the transport roller pair 26 is conveyed with a predetermined timing by the register roller pair 28 toward a transfer area formed by the photoconductor drum 14 and the transfer roller 20. During passage of the sheet through the transfer area, the developed image formed on the surface of the photoconductor drum 14 is transferred onto an upward surface of the sheet by the transfer roller 20. The sheet having the image transferred onto it is transported to the fixing device 24 by the carrier belt mechanism 30, and the image is fixed onto the upward surface of the sheet during passage through the fixing device 24. The sheet having the imaged fixed on the surface is transported further downstream by the transport roller pair 32. In the thus described manner, the image is formed on the upward surface of the sheet during transport of the sheet on the image forming transport path 10.

Figure 2:
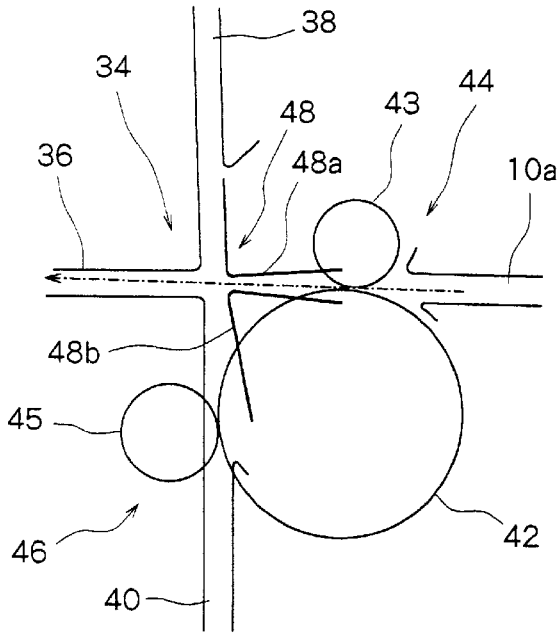
FIG. 2 is an enlarged schematic view of the structure of a four-forked portion located in a downstream end portion of an image forming transport path provided in the electrostatic copier of FIG. 1.
Figure 3:
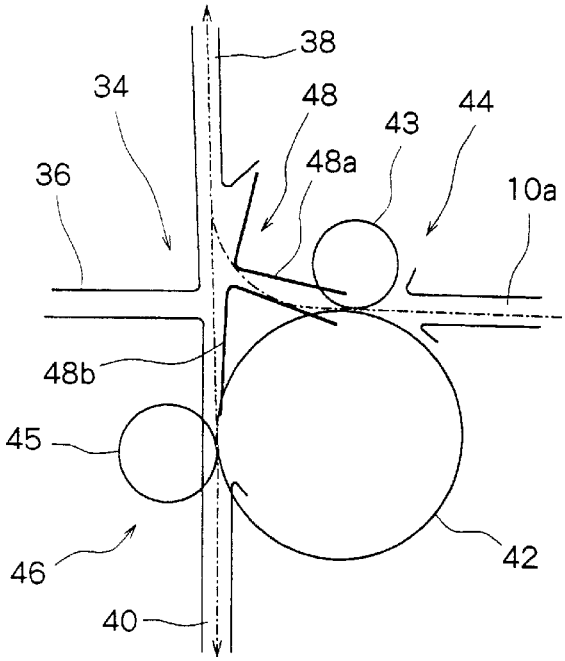
FIG. 3 is a view showing another manner of action of the four-forked portion shown in FIG. 2.
Figure 4:
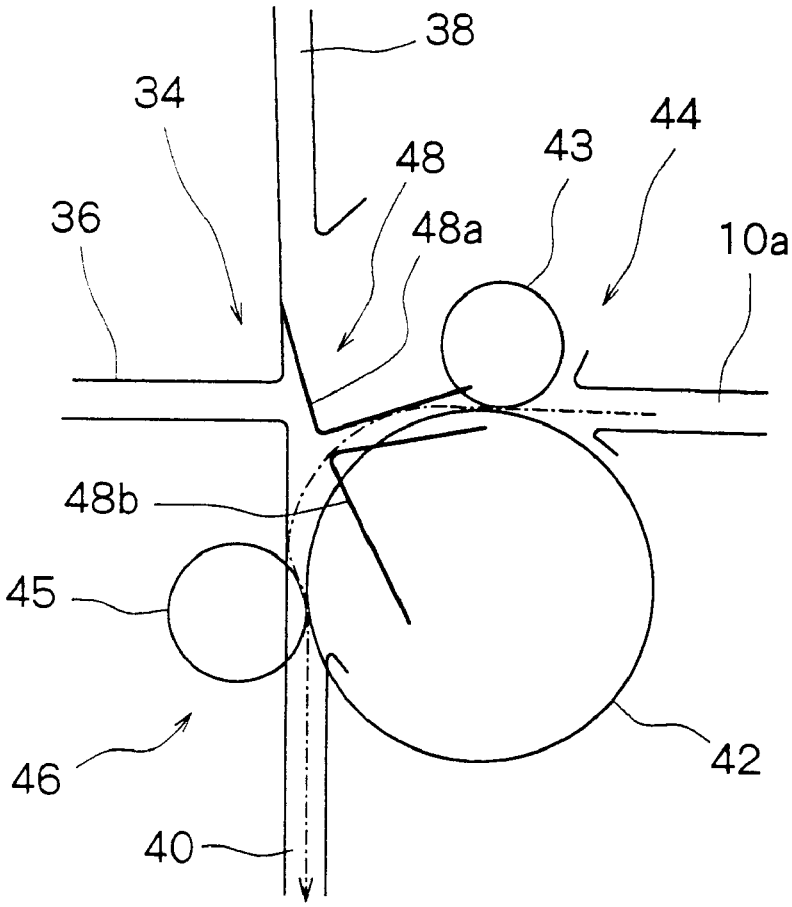
FIG. 4 is a view showing still another manner of action of the four-forked portion shown in FIG. 2.

With reference to FIGS. 2 to 4, a punching means 33, a post-treating means for a sheet, is disposed at a position in the image forming transport path 10 downstream from the fixing device 24. When a sheet is to be punched by the punching means 33 which may be a publicly known structure per se, the sheet is once stopped during its passage through the punching means 33. At the time of its stoppage, an end portion of the sheet (a downstream end portion or an upstream end portion in the direction of transport) is punched. In this embodiment, punching is applied to the downstream end portion, in the direction of transport, of the sheet. More concretely, the punching means 33 has a sheet stopper (not shown). The sheet stopper is disposed so as to be selectively brought by a drive means, such as cam, to a retreat position at which the sheet stopper retreats from the image forming transport path 10 and permits transport of the sheet, and a stop position at which the sheet stopper protrudes into the image forming transport path 10 to block the image forming transport path 10, and contacts a downstream end in the transport direction of the sheet being transported to stop the movement of the sheet temporarily, thereby putting the sheet to a predetermined punched position. When the sheet stopper is located at the stop position with a predetermined timing with respect to the transport of the sheet, the sheet being transported is stopped at the punched position. Then, a punch of the punching means is reciprocated in a face-and-back direction of the sheet to carry out punching at a predetermined position of an end portion, the downstream end portion of the sheet.

At a position in the image forming transport path 10 downstream from the punching means 33, a four-forked passageway 34 is provided which is formed by combining a plurality of guide plates. The four-forked passageway 34 is composed of a downstream end portion 10*a* of the image forming transport path 10, a discharge path 36 placed on an extension of the downstream end portion 10*a* of the image forming transport path 10, a reversing transport path 38 branching off upward from the downstream end portion 10*a* of the image forming transport path 10, and a returning path 40 branching off downward from the downstream end portion 10*a* of the image forming transport path 10. The returning path 40 is placed on a downward extension of the reversing transport path 38. At a corner in the four-forked passageway 34 between the returning path 40 and the downstream end portion 10*a* of the image forming transport path 10, a large-diameter roller 42 is disposed. At a part of the outer peripheral surface of the large-diameter roller 42 positioned in the downstream end portion 10*a* of the image forming transport path 10, a small-diameter roller 43 is nipped. At another part of the outer peripheral surface of the large-diameter roller 42 positioned in the returning path 40, another small-diameter roller 45 is nipped. The large-diameter roller 42 and the small-diameter roller 43 constitute a transport roller pair 44, while the large-diameter roller 42 and the small-diameter roller 45 constitute a transport roller pair 46.

On the four-forked passageway 34, there is disposed a guide means 48 capable of selectively guiding the sheet, which has been transported through the image forming transport path 10, toward the discharge path 36 or the reversing transport path 38 or the returning path 40, and also guiding the sheet, which has been transported to the reversing transport path 38, toward the returning path 40. The guide means 48 is composed of a guide plate 48*a* of a nearly L-shaped section which comprises a guide piece defining the downstream end portion 10*a* of the image forming transport path 10, and a guide piece integral with the guide piece and defining an inlet end portion of the reversing transport path 38, and a guide plate 48*b* of a nearly L-shaped section which comprises another guide piece defining the downstream end portion 10*a* of the image forming transport path 10, and another guide piece integral with the guide piece and defining an inlet end portion of the returning path 40. The guide plates 48*a* and 48*b* are coupled to an actuating mechanism, including a solenoid (not shown), so that they can be turned integrally with their relative positions being fixed.

When the guide means 48 is positioned by the actuating mechanism (not shown) to a first guide position shown in FIG. 2, the image forming transport path 10 and the discharge path 36 are brought into communication. The sheet transported in the image forming transport path 10 is discharged by the transport roller pair 44 through the discharge path 36 onto a non-sorting discharge tray 4*a* disposed on one side of the copier body 4 which is the downstream end of the discharge path 36. When the guide means 48 is positioned to a second guide position shown in FIG. 3, the image forming transport path 10 and the reversing transport path 38, and the reversing transport path 38 and the returning path 48 are each brought into communication. The sheet transported through the image forming transport path 10 is introduced into the reversing transport path 38 by the transport roller pair 44, and the sheet introduced into the reversing transport path 38 is reversely transported (switched back) toward the returning path 40 in a manner to be described later on. When the guide means 48 is brought to a third guide position as shown in FIG. 4, on the other hand, the image forming transport path 10 and the returning path 40 are brought into communication. The sheet transported through the image forming transport path 10 is transported into the returning path 40 by the transport roller pairs 44 and 46.

The reversing transport path 38, in which the transport direction of the sheet selectively introduced from the four-forked passageway 34, a downstream site of the image forming transport path 10, is reversed, extends upwards from the four-forked passageway 34 along one side in the copier body 4. On one side of the copier body 4 and above the non-sorting discharge tray 4*a*, a sheet rest 4*b* is disposed which is hollow inside. The reversing transport path 38 is connected to the sheet rest 4*b*. A downstream end portion of the reversing transport path 38 is defined by the sheet rest 4*b*. On the reversing transport path 38, a roller pair 50 capable of normal rotation and reverse rotation is disposed. The sheet introduced into the reversing transport path 38 by the transport roller pair 44 is carried toward the sheet rest 4*b* by the normally rotated roller pair 50. At a position immediately upstream from the roller pair 50, a sheet detector (not shown) is disposed. When the sheet detector detects the passage of the sheet, the roller pair 50 is once stopped, with an end portion of the sheet being nipped thereby, and then the roller pair 50 is reversely rotated. As a result of this motion, the direction of transport of the sheet is reversed, whereby the sheet is switched back toward the four-forked passageway 34. Then, the sheet is transported by the transport roller pair 46 from the four-forked passageway 34 toward the returning path 40. The sheet released from the nip by the roller pair 50 is transported toward the returning path 40 by the transport roller pair 46.

The returning path 40, in which the sheet reversely transported from the reversing transport path 38 is returned below the image forming transport path 10 with the directions of the face and back of the sheet being unchanged, extends downwards from the four-forked passageway 34 along one side in the copier body 4, and then curves. Then, the returning path 40 extends below, and at a distance from, the image forming transport path 10 in a direction from a downstream position toward an upstream position of the image forming transport path 10. In the returning path 40, a plurality of return roller pairs, i.e., five return roller pairs 52, 54, 56, 58 and 59 in the present embodiment, are disposed with spacing in the direction of returning. A downstream portion of the returning path 40 is connected to an inverting transport path 60 in which the sheet returned through the returning path 40 is turned upside down and readmitted into an upstream portion of the image forming transport path 10. On the inverting transport path 60, a transport roller pair 62 is placed for readmitting the sheet, which has been returned through the returning path 40, into the upstream portion of the image forming transport path 10. The sheet, which has been reversely transported from the reversing transport path 38, and then put into the returning path 40 by the transport roller pair 46, is returned toward the inverting transport path 60 by the return roller pairs 52, 54, 56, 58 and 59, and then readmitted into an upstream portion of the image forming transport path 10 (a portion upstream from the register roller pair 28) by the transport roller pair 62 in the inverting transport path 60. The sheet readmitted into the image forming transport path 10 is transported again through the image forming transport path 10. During this re-transport, an image is formed by the image forming means on the other surface of the sheet directed upwards as a result of inversion.

Figure 5:
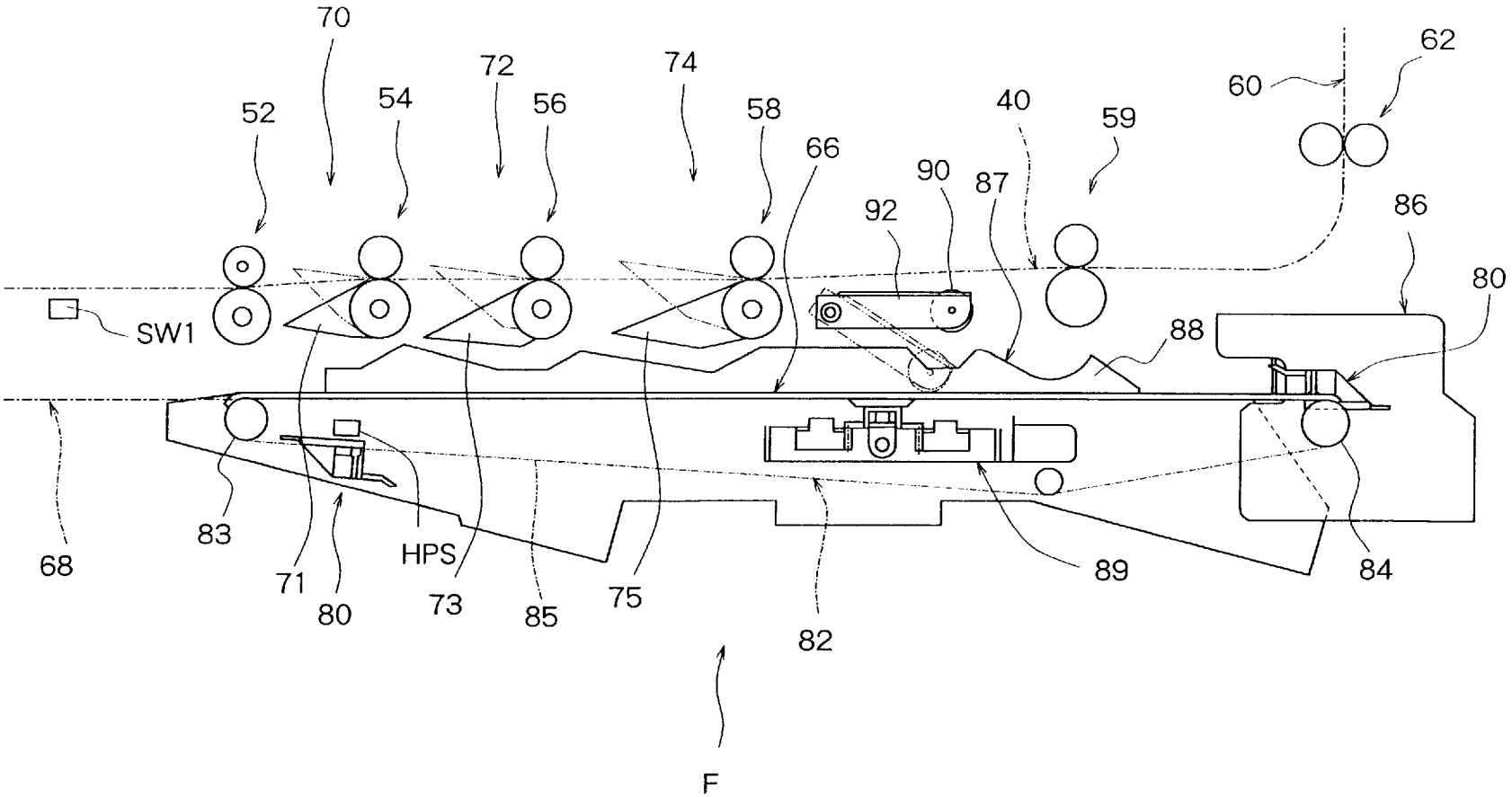
FIG. 5 is an enlarged schematic view of a sheet receiving stand and a send-in means provided in the electrostatic copier shown in FIG. 1.

With reference to FIG. 5 along with FIG. 1, a finisher F is disposed inside the copier body 4. The finisher F housed in the copier body 4 has a sheet receiving stand 66. The sheet receiving stand 66 is placed below the returning path 40 in such a manner as to extend practically along the returning path 40 with spacing from the returning path 40. In the direction of extension of the sheet receiving stand 66, namely, the direction to one side of the copier body 4 on which the non-sorting discharge tray 4*a* is disposed, a discharge path 68 is provided. At a downstream end of the discharge path 68 and on the one side of the copier body 4, a sorting discharge tray 4*c* is disposed. On the discharge path 68, a sorting discharge roller pair 69 is disposed. On the returning path 40, at least one send-in means is disposed for selectively sending in the sheet, which is returned through the returning path 40, onto the sheet receiving stand 66 in the finisher F. The copier 2 is constituted such that a plurality of types of sheets having different lengths (sizes) in the direction of transport can be copied. Thus, the send-in means are disposed in the returning path 40 at a plurality of positions corresponding to a plurality of types of sheets having different lengths in the direction of transport so that the plurality of types of sheets will be selectively returned, and that the sheet is selectively sent in from the plurality of positions toward the sheet receiving stand 66. In the embodiments shown in FIGS. 1 and 5, the sheets to be returned through the returning path 40 are classified into three types, i.e., a sheet of A3 size according to JIS which is returned in the machine direction (hereinafter referred to as "machine-direction A3 sheet"), a sheet of A4 size which is sent in the machine direction (hereinafter referred to as "machine-direction A4 sheet"), and a sheet of A4 size which is sent in the cross direction (hereinafter referred to as "cross-direction A4 sheet"). Thus, three send-in means 70, 72 and 74 are arranged at three different positions.

The send-in means 70 is composed of the return roller pair 52 located at the most upstream position of the return roller pairs arranged in the returning path 40 extending below the image forming transport path 10, and a movable guide member 71, a movable guide means, disposed downstream from the return roller pair 52. The send-in means 72 is composed of the return roller pair 54 located downstream from the return roller pair 52, and a movable guide member 73, a movable guide means, disposed downstream from the return roller pair 54. The send-in means 74 is composed of the return roller pair 56 located downstream from the return roller pair 54, and a movable guide member 75, a movable guide means, disposed downstream from the return roller pair 56. Each of the movable guide members 71, 73 and 75 is constituted so as to selectively position the sheet, which has been returned by the return roller pairs 52, 54, 56, at a first guide position (a position indicated by a solid line in FIG. 5) at which the guide member guides the sheet toward the inverting transport path 60 along the returning path 40, and at a second guide position (a position indicated by a two-dot chain line in FIG. 5) at which the guide member guides the sheet toward the sheet receiving stand 66. This positioning action is performed with the use of an actuating mechanism including a solenoid (not shown). When the machine-direction A3 sheet transported through the returning path 40 is to be sent in onto the sheet receiving stand 66, the movable guide member 71 of the send-in means 70 is brought to the second guide position. When the machine-direction A4 sheet transported through the returning path 40 is to be sent in onto the sheet receiving stand 66, the movable guide member 73 of the send-in means 72 is brought to the second guide position. When the cross-direction A4 sheet transported through the returning path 40 is to be sent in onto the sheet receiving stand 66, the movable guide member 75 of the send-in means 74 is brought to the second guide position.

The sheet receiving stand 66 has a longitudinal length and a width which enable a plurality of types of sheets with different lengths in the transport direction to be accepted. In the present embodiment, the sheet receiving stand 66 has a longitudinal length and a width which can accommodate three types of sheets, the machine-direction A3 sheet, the machine-direction A4 sheet, and the cross-direction A4 sheet. The finisher F has a catching member 80, which is a catching means capable of catching an end of the sheet selectively sent in onto the sheet receiving stand 66 by one of the send-in means 70, 72 and 74 and storing the sheets, and a sheet moving means 82 capable of moving the sheet caught by the catching member 80 toward the sorting discharge roller pair 69, accordingly, the sorting discharge tray 4*c*. The sheet moving means 82 has a driving pulley 83 and a driven pulley 84 disposed with spacing in the longitudinal direction of the sheet receiving stand 66, an endless belt 85 looped between the driving pulley 83 and the driven pulley 84, and an electric motor (not shown), a drive source for rotationally driving the driving pulley 83. The endless belt 85 has a linear moving portion which linearly extends between the driving pulley 83 and the driven pulley 84. This linear moving portion extends in the longitudinal direction of the sheet receiving stand 66 along the back of the sheet receiving stand 66, and can move in the same direction. When the electric motor is rotationally driven, the endless belt 85 is rotationally driven counterclockwise in FIG. 5, so that the linear moving portion of the endless belt 85 is moved from one site in the longitudinal direction of the sheet receiving stand 66 toward the sorting discharge tray 4*c*.

On the endless belt 85, the catching member 80 is mounted integrally. In the present embodiment, two of the catching members 80 having substantially the same constitution are mounted at substantially equally spaced positions in both directions along the periphery of the endless belt 85. In other words, the catching members 80 are mounted at such peripheral positions of the endless belt 85 that when the endless belt 85 is rotated a half turn in the peripheral direction, each of the catching members 80 is put to the initial position of the other catching member 80. The finisher F has a stapler 86, a sheet post-treating means. The stapler 86 is disposed at an end portion across the sheet receiving stand 66 from the sorting discharge tray 4*c*. A catching position (home position) of the one catching member 80 is set to agree with a posttreatment position at which posttreatment by the stapler 86 is performed. To position the one catching member 80 at the home position, a single home position sensor HPS capable of detecting the home position of the other catching member 80 is placed on the moving path of the endless belt 85 which is opposed to the moving path of the linear moving portion of the endless belt 85. Each of the catching members 80 has a substantially L-shaped portion when viewed from the width direction of the sheet receiving stand 66 (the face-and-back direction in FIGS. 1 and 5). When positioned on the linear moving portion of the endless belt 85, the catching member 80 protrudes from the surface of the sheet receiving stand 66 (the surface to accept the sheet). When viewed from the width direction, the catching member 80 forms a sheet catching portion of a substantially channel shape with respect to the surface of the sheet receiving stand 66, the sheet catching portion extending in the width direction of the sheet receiving stand 66. The width of each of the catching members 80 (the width in the same direction as the width of the sheet receiving stand 66) is set to be such a length as to be capable of catching and storing the sheets of each size. The endless belt 85 is placed in a widthwise central portion of the sheet receiving stand 66. Thus, a moving space (not shown) is provided in the widthwise central portion of the sheet receiving stand 66 so that the catching member 80 can move in the longitudinal direction without interfering with the sheet receiving stand 66.

On the sheet receiving stand 66, an aligning means 87 for sheets is provided. The aligning means, which may use a well known structure per se, has a pair of width adjusting plates 88 positioned with spacing in the width direction of the sheet receiving stand 66, and a width adjusting mechanism 89 for reciprocating the pair of width adjusting plates 88 in the width direction. The pair of width adjusting plates 88 are arranged so as to be movable in a reciprocating manner in the width direction along the surface of the sheet receiving stand 66. The width adjusting mechanism 89, although not clearly shown, has moving bodies (including racks) disposed so as to be capable of reciprocating independently of each other in the width direction in correspondence with the respective width adjusting plates 88, pinion gears disposed to engage the racks of the moving bodies, and electric motors as drive sources disposed in correspondence with the pinion gears so as to be capable of rotationally driving the pinion gears independently of each other. The electric motors can make normal and reverse rotations. The width adjusting plates 88 are mounted on the corresponding moving bodies, and are moved in the width direction integrally therewith. Home position sensors (not shown) for detecting the home positions of the width adjusting plates 88 are disposed in correspondence with the width adjusting plates 88. On each of the electric motors, a rotation amount detector, such as a rotary encoder or a frequency generator, is mounted. Based on detection signals from these members, the amount of movement of the width adjusting plate 88 adapted to the size of the sheet is defined.

At a position in the finisher F downstream from the return roller pair 58, a feed roller means including a feed roller 90 is provided for pressing the sheet, which has been sent in onto the sheet receiving stand 66 by one of the send-in means 70, 72 and 74, and transporting the sheet until its end substantially contacts the catching member 80. The feed roller means has a rotational drive shaft provided so as to extend in the width direction of the sheet receiving stand 66, a pair of lever members 92 turnably supported on the rotational drive shaft with spacing in the axial direction, a rotating shaft supported by the respective front end portions of the lever members 92, and the feed roller 90 mounted integrally on the rotating shaft. The rotating shaft of the feed roller 90 is drivingly connected to the rotational drive shaft via pulleys and an endless belt (not shown). The rotational drive shaft for the feed roller 90 is drivingly connected to an electric motor, a drive source (not shown). The lever members 92 are coupled to solenoids (not shown). When the sheet is sent in onto the sheet receiving stand 66 by one of the send-in means 70, 72 and 74, the feed roller 90 is put by the solenoids to an operating position indicated by a two-dot chain line in FIG. 5, and is rotationally driven to transport the sheet toward the catching member 80 while pressing the sheet against the surface of the sheet receiving stand 66. When the sheets caught by and stored in the catching member 80 are to be moved toward the sorting discharge tray 4*c* by the sheet moving means 82, the solenoids are deenergized, whereupon the feed roller 90 is brought to a retreat position indicated by a solid line in FIG. 5.

At a position in the copier body 4 below the sheet receiving stand 66, a tray 94 is placed for accommodating sheets upwardly and downwardly movably. Below the tray 94, cassettes 95 and 96 are placed. Each of the tray 94 and the cassettes 95 and 96 is placed such that the sheets accommodated therein can be fed to a sheet feeding transport path 97 extending in the copier body 4 along the other side (right-hand side in FIG. 1) of the copier body 4. A downstream end of the sheet feeding transport path 97 is connected to an upstream site of the image forming transport path 10 (a site upstream from the transport roller pair 26). In correspondence with the tray 94 and the cassettes 95 and 96, sheet feed roller pairs and separation roller pairs are disposed. On the sheet feeding transport path 97, a plurality of sheet feed roller pairs 98 are disposed. The sheets accommodated in the tray 94 and the cassettes 95 and 96 are fed to the sheet feeding transport path 97 by the action of the sheet feed roller pairs and separation roller pairs disposed in correspondence therewith, and are transported to the image forming transport path 10 by the sheet feed roller pairs 98.

The copier body 4 has a control means (not shown). The control means is composed of a microcomputer, comprising a central processing unit (CPU) for performing computation in accordance with a control program, a ROM for storing the control program, a RAM for storing the results of computation, a timer, a counter, an input interface, and an output interface. The input interface of the so constituted control means receives detection signals from the sheet detector, the home position sensor HPS, a sheet sensor switch SW1, and other various types of sensors (detectors) and switches. The output interface produces control signals for various electric motors, various solenoids, and other drive sources. The control means of the copier body 4 receives copy information from keys disposed in the operating means, such as a copy start key, a sheet size (transport direction length) setting key, a copy number setting key, a double-sided copy setting key for designating double-sided copying, a staple setting key for designating stapling, a staple number setting key for designating the number of sheets to be stapled per set of documents, a staple set number setting key for designating the number of the stapled sheet sets, a punch setting key for designating punching, a punch number setting key for designating the number of sheets to be punched per set of documents, and a punch set number setting key for designating the number of the punched sheet sets (none of these keys are shown).

The image forming machine according to the illustrated embodiment is constituted as described above. Its actions to be carried out when a punching mode in double-sided copying is designated will be described with reference to FIGS. 1 and 5. A sheet of the designated size fed from the tray 94 or cassette 95 or 96 is fed to an upstream position of the image forming transport path 10 through the sheet feeding transport path 97. Then, an image is formed on an upward surface of the sheet during its transport through the image forming transport path 10. The guide means 48 on the four-forked passageway 34 is brought to the second guide position shown in FIG. 3. The sheet stopper (not shown) of the punching means 33 is positioned at the stop position. The sheet having the image formed on one surface thereof has the one end thereof brought into contact with the sheet stopper during passage through the punching means 33. Thus, its movement is stopped, and the sheet is put to the punched position. Simultaneously, the rotational driving of the transport roller pair 32 is stopped. These actions of the guide means 48, the sheet stopper, and the transport roller pair 32 can be performed, for example, based on sheet detection signals from a sheet detector (not shown) disposed at a position in the image forming transport path 10 upstream from the punching means 33. Then, in the manner described earlier, punching is applied at a predetermined position in an end portion of the sheet. After punching treatment, the sheet stopper is brought to the retreat position.

Then, the transport roller pair 32 is rotationally driven, whereby the sheet having the end portion punched is transported again through the image forming transport path 10 toward the four-forked passageway 34. After introduction into the reversing transport path 38 at the four-forked passageway 34, this sheet is reversely transported toward the returning path 40. All the movable guide members 71, 73 and 75 of the send-in means 70, 72 and 74 disposed in the returning path 40 are brought to the first guide position indicated by the solid lines in FIG. 5. This action is implemented, for example, based on the first detection signals from a sheet send-in detection switch (not shown) disposed at an upstream position of the returning path 40. The sheet introduced into the returning path 40 is returned through the returning path 40 by the return roller pairs 52, 54, 56, 58 and 59 such that the directions of the face and back of the sheet are the same as in the image forming transport path 10. In the inverting transport path 60, the sheet is turned upside down and readmitted into the image forming transport path 10. During readmission of the sheet through the image forming transport path 10, an image is formed on the other surface directed upwards as a result of inversion. The position of the guide means 48 in the four-forked passageway 34 is shifted from the second guide position shown in FIG. 3 to the third guide position shown in FIG. 4. The sheet having images formed on both surfaces thereof and punched in one end portion thereof is transported at the four-forked passageway 34 toward the returning path 40.

When this sheet is sent into the returning path 40 and the sheet send-in detection switch produces the second detection signal, one of the movable guide member 71 of the send-in means 70, the movable guide member 73 of the send-in means 72, and the movable guide member 75 of the send-in means 74 is moved from the first guide position (the position indicated by the solid line in FIG. 5) to the second guide position (the position indicated by the two-dot chain line in FIG. 5) in correspondence with the sheet of the designated size. In the case of a machine-direction A3 sheet of the longest length designated, the movable guide member 71 of the send-in means 70 is put to the second guide position, so that the machine-direction A3 sheet returned through the returning path 40 is guided to the movable guide member 71 by the return roller pair 52 and conveyed onto the sheet receiving stand 66. In the case of a machine-direction A4 sheet of the next longest length designated, the movable guide member 73 of the send-in means 72 is put to the second guide position, so that the machine-direction A4 sheet returned through the returning path 40 is guided to the movable guide member 73 by the return roller pair 54 and conveyed onto the sheet receiving stand 66. In the case of a cross-direction A4 sheet of the shortest length designated, the movable guide member 75 of the send-in means 74 is put to the second guide position, so that the cross-direction A4 sheet returned through the returning path 40 is guided to the movable guide member 75 by the return roller pair 56 and conveyed onto the sheet receiving stand 66. During this period, the feed roller 90 is moved from the retreat position to the operating position and also rotationally driven to transport the sheet, conveyed onto the sheet receiving stand 66, toward one of the catching members 80 positioned at the home position until one end of the sheet arrives at the catching member 80, while pressing the sheet against the surface of the sheet receiving stand 66. In this manner, the sheet is brought to the catching position by the catching member 80. When the one end of the sheet reaches the catching member 80, the feed roller 90 is brought from the operating position to the retreat position. After such sheet positioning is carried out with respect to the catching member 80 put to the home position on the sheet receiving stand 66, each of the electric motors (not shown) in the width adjusting mechanism 89 of the aligning means 87 is driven to make normal rotation. Thus, each of the width adjusting plates 88 is moved toward each other from the home position by a predetermined distance to align the sheets on the sheet receiving stand 66. After sheet alignment, each of the electric motors is driven to make a reverse rotation. Thus, each of the width adjusting plates 88 is moved away from each other to the home position by a predetermined distance.

The foregoing control of the feed roller 90 by the control means is easily performed, for example, by placing the sheet sensor switch SW1 at a position in the returning path 40 upstream from the return roller pair 52. That is, with one of the movable guide members 71, 73 and 75 being put to the second guide position (the position indicated by the two-dot chain line in FIG. 5), the sheet sensor switch SW1 detects the front end of the sheet to be returned, and becomes ON. A predetermined period of time after the ON state is reached, the solenoid (not shown) is energized to bring the feed roller 90 to the operating position. A predetermined time after positioning of the feed roller 90 at the operating position, it is judged that one end of the sheet has reached the catching member 80. Upon this judgment, the solenoid is deenergized to bring the feed roller 90 to the retreat position. The sheet is caught at the home position by the catching member 80 kept at the home position.

In the manner described above, the sheets having images formed on both surfaces and punched in one end portion are stored in the punch number in the catching member 80. The number of the sheets to be punched per set of the documents can be counted based on the number of ON-OFF's of the sheet sensor switch SW1, with one ON-OFF being counted as one punching, and with one of the movable guide members 71, 73 and 75 being brought to the second guide position (the position indicated by the two-dot chain line in FIG. 5). When the sheets having images formed on both surfaces and punched in one end portion are stored by the punch number in the catching member 80 in the above-described manner, the electric motor (not shown) is rotationally driven to drive the endless belt 85 rotationally counterclockwise in FIGS. 1 and 5. The catching member 80 moves a pile of the sheets, having images formed on both surfaces and punched in one end portion, toward the sorting discharge roller pair 69, accordingly, toward the sorting discharge tray 4*c*. The pile of sheets is discharged onto the sorting discharge tray 4*c* by the sorting discharge roller pair 69. When the catching member 80, which has moved the pile of sheets toward the sorting discharge roller pair 69, is moved to the position of the home position sensor HPS, the sensor HPS becomes ON to terminate the rotational driving of the electric motor. At the same time, the other catching member 80 is put to the home position corresponding with the posttreatment position. This punching procedure is repeated until the punch set number designated by the punch set number setting key is reached. The punch set number can be counted such that the pile of punched sheets moved and discharged onto the sorting discharge tray 4*c* gives the punch set number 1 (1 set). The piles of sheets are shifted by the aligning means 87 by a predetermined distance toward one edge for alternate sets, such as the 1st set, the 3rd set, the 5th set, and so on. On the sorting discharge tray 4*c*, the shifted piles of sheets are stored alternately one set at a time.

When the stapling mode in double-sided copying is designated, substantially the same double-sided copying action as the double-sided copying action in the above-described punching mode is performed, except that the order of images produced on the face and back of the same sheet is reversed. The sheet subjected to double-sided copying is fed onto the sheet receiving stand 66 without undergoing punching. When the sheets having images formed on both surfaces are stored by the staple number in the catching member 80 on the sheet receiving stand 66, there is performed a predetermined aligning action by the aligning means 87 (the action of determining a stapling position in the width direction for arbitrarily adjusting the widthwise position of the sheet pile, such as for central stapling or edge stapling). Then, the stapler 86 is actuated to staple the sheet pile having the stable number of sheets. After stapling, the pile of sheets having images formed on both surfaces is discharged by the catching member 80 onto the sorting discharge tray 4*c* in accordance with the same procedure as in the punching mode.

When a mere double-sided copying mode involving double-sided copying and using a copy number which has been set is designated, punching is not carried out, and substantially the same double-sided copying action as the double-sided copying action in the above-described punching mode is performed. The guide means 48 on the four-forked passageway 34 is brought to the first guide position shown in FIG. 2. The sheet having images formed on both surfaces is discharged onto the non-sorting discharge tray 4*a* past the discharge path 36 at the four-forked passageway 34. This procedure is executed until the sheets having images formed on both surfaces are discharged in the set copy number onto the non-sorting discharge tray 4*a*.

In the above-described copier 2 as an image forming machine, the finisher F is provided (housed) which includes the sheet receiving stand 66 placed below the returning path 40. On the returning path 40, at least one send-in means (at least one of the send-in means 70, 72 and 74) is disposed for selectively sending in the sheet, returned through the returning path 40, onto the sheet receiving stand 66. Thus, sheet posttreatment can be performed without the necessity of producing the finisher F independently and providing it on one side of the copier body 4 as done in the earlier technologies. Consequently, there is no need for conventional finisher F installation work, including a height adjustment task, so that a labor burden can be reduced, and the installation time becomes unnecessary. Nor is there need for a surplus installation space in the lateral direction of the copier body 4 that has been hitherto required. Thus, a marked saving in space can be realized. Furthermore, it becomes unnecessary to transport sheets from the copier body 4 to the finisher F attached to the copier body 4 as done so far. Sheet transport takes place through a predetermined transport path placed within the copier body 4, so that the transport of sheets to the finisher F can be performed stably. As a result, a jam or the occurrence of a defective product can be prevented reliably.

On the returning path 40, at least one send-in means (at least one of the send-in means 70, 72 and 74) is disposed for selectively sending in the sheet, returned through the returning path 40, onto the sheet receiving stand 66. Thus, the returning path 40 can concurrently serve as a send-in path to the sheet receiving stand 66, and can omit independent transport and send-in paths to the sheet receiving stand 66 as used in the conventional technologies. This reduces the number of parts, simplifies the structure, and decreases the cost. On the returning path 40, the plurality of return roller pairs 52, 54, 56, 58 and 59 are disposed with spacing in the returning direction. The send-in means (70, 72, 74) are composed of the return roller pairs (52, 54, 56), and the movable guide members (71, 73, 75) which are disposed downstream from the return roller pairs (52, 54, 56) and which are selectively brought to the first guide position at which the movable guide members guide the sheet, returned by the return roller pairs (52, 54, 56), toward the inverting transport path 60 along the returning path 40, and the second guide position at which the movable guide members guide the sheet, returned by the return roller pairs (52, 54, 56), toward the sheet receiving stand 66. As noted from this, the send-in means (70, 72, 74) can be installed simply by disposing the movable guide members (71, 73, 75) in conjunction with the return roller pairs (52, 54, 56) disposed along the returning path 40. Thus, the image forming machine can be easily actualized with a simple structure and at a low cost.

The sorting discharge tray 4*c* is disposed in the direction of extension of the sheet receiving stand 66, and the finisher F has the catching member 80 capable of catching the end of the sheet, selectively sent in by the send-in means (at least one of the send-in means 70, 72, 74), and storing the sheets, and the sheet moving means 82 capable of moving the sheet, caught by the catching member 80, toward the sorting discharge tray 4*c*. Thus, a pile of sheets formed after feeding onto the sheet receiving stand 66 is moved sideways within the copier body 4 by the sheet moving means 82, and is discharged onto the sorting discharge tray 4*c* easily and reliably.

At the downstream end of the image forming transport path 10, the discharge path 36 is disposed for discharging a sheet, which has been transported through the image forming transport path 10, onto the non-sorting discharge tray 4*a*. The four-forked passageway 34 is disposed at a downstream position of the image forming transport path 10. On the four-forked passageway 34, the guide means 48 is disposed which can selectively guide the sheet, which has been transported through the image forming transport path 10, toward the discharge path 36, or the reversing transport path 38, or the returning path 40, and can selectively guide the sheet, which has been introduced into the reversing transport path 38, toward the returning path 40. This constitution of the four-forked passageway 34 and the guide means 48 makes it possible to transport the sheet, transported through the image forming transport path 10, freely toward the non-sorting discharge tray 4*a* or the reversing transport path 38 or the returning path 40, and to transport the sheet, introduced into the reversing transport path 38, reversely toward the returning path 40. Thus, the desired processing mode can be easily implemented.

In the invention having the punching means 33 disposed at the downstream position of the image forming transport path 10, when the punching mode in double-sided copying is designated, punching of a sheet can be performed immediately after image formation on one surface of the sheet, rather than after image formation on both surfaces of the sheet, as done in the earlier technologies. Thus, the distance of transport of the sheet until one end of the sheet contacts the sheet stopper (not shown) of the punching means 33 after image formation on one surface of the sheet is markedly decreased in comparison with the earlier technologies. It goes without saying that no sheet inverting action is involved during that period. Thus, the possibility for displacement of the sheet in the transport width direction during the sheet transport process is substantially reduced to zero. Hence, variations in the punching position in the transport width direction of the sheet among a plurality of punched sheets are nonexistent substantially. Consequently, a set of sheets consisting of a plurality of punched sheets having images formed on both surfaces thereof can be reliably prevented from hole misalignment because of desired, high accuracy alignment of the respective holes of the sheets. As noted from this, stable punching accuracy and quality can be ensured.

In the copier 2 as an image forming machine, the send-in means (70, 72 and 74) are disposed in the returning path 40 at a plurality of positions (three different positions corresponding to machine-direction A3 sheet, machine-direction A4 sheet, and cross-direction A4 sheet in the embodiments) corresponding to a plurality of types of sheets with different lengths (sizes) in the direction of transport (in the embodiments, three types of sheets, i.e., machine-direction A3 sheet, machine-direction A4 sheet, and cross-direction A4 sheet) so that the plurality of types of sheets with different lengths in the direction of transport may be selectively returned, and the sheet may be selectively sent in toward the sheet receiving stand 66 from any of the three different positions. As a result, the sheet is sent in from the optimal send-in position adapted for its size, relative to the catching member 80 brought to a predetermined catching position. Thus, slipping-in of sheets to be accepted by the sheet receiving stand 66 can be reliably prevented, and the pile of sheets arranged in the desired correct order can be formed. In the above-described embodiment, the stapler 86, a sheet post-treating means, is placed at the other end of the sheet receiving stand 66 (the end on the side opposite to the side of the sorting discharge tray 4*c*). The catching position (home position) of the catching member 80 lies at a post-treatment position at which posttreatment by the stapler 86 is carried out. According to this constitution, the pile of sheets caught by the catching member 80 is subjected to stapling at the same position regardless of the size of the sheets.

Figure 6:
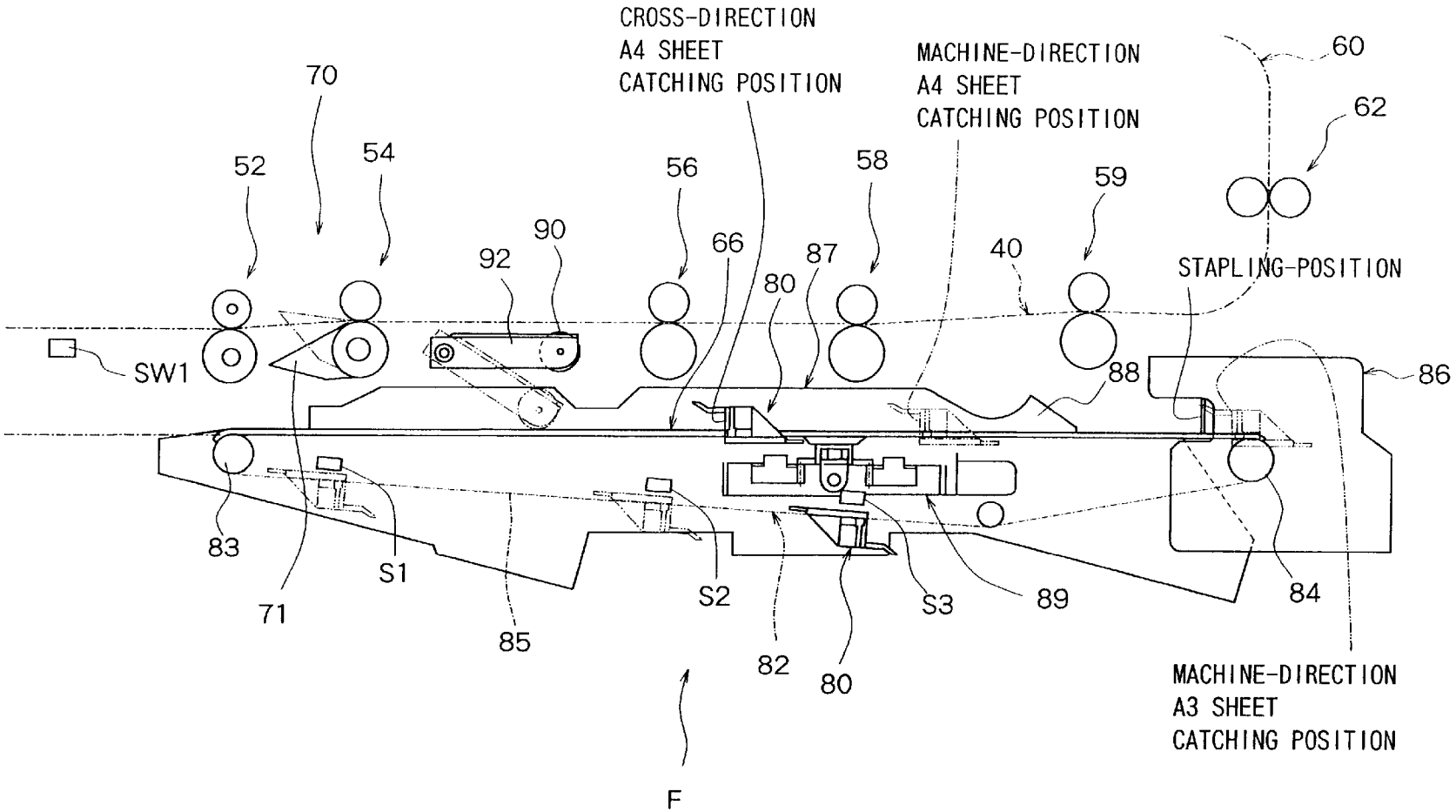
FIG. 6 is an enlarged schematic view of another embodiment of a finisher and the send-in means.

FIG. 6 shows another embodiment of the finisher F and the send-in means for the sheet receiving stand 66 incorporated in the copier body 4. In FIG. 6, substantially the same parts as the parts shown in FIG. 5 are indicated by the same numerals, and their explanations are omitted. On a returning path 40, return roller pairs 52, 54, 56, 58 and 59 are arranged as in the previous embodiment. A feed roller means including a feed roller 90 is placed between a return roller pair 54 and a return roller pair 56. Send-in means disposed is only the send-in means 70 shown in FIG. 5, i.e., send-in means 70 composed of the return roller pair 52 and a movable guide member 71. The send-in means 70 is disposed so as to send in the sheet toward a catching member 80 from one end portion of the sheet receiving stand 66 facing a sorting discharge roller pair 69, accordingly, a sorting discharge tray 4*c*. The catching member 80 is provided in a sheet moving means 82, and adapted to be selectively moved to a plurality of catching positions, corresponding to a plurality of types of sheets with different lengths in the direction of transport (machine-direction A3 sheet, machine-direction A4 sheet, and cross-direction A4 sheet), relative to the send-in means 70, namely, three catching positions in the embodiment.

An electric motor (not shown) for rotationally driving a driving pulley 83 in the sheet moving means 82 is composed of an electric motor capable of normal and reverse rotations. When this electric motor is driven to make normal rotation, an endless belt 85 is rotationally driven in one direction (counterclockwise in FIG. 6), whereby a linear moving portion of the endless belt 85 is moved toward the sorting discharge tray 4*c* from right in FIG. 6 on the sheet receiving stand 66 (the side opposite to the sorting discharge tray 4*c*) to left in FIG. 6 on the sheet receiving stand 66. When the electric motor is driven to make reverse rotation, the endless belt 85 is rotationally driven in the other direction (clockwise in FIG. 6), whereby the linear moving portion of the endless belt 85 is moved from left to right on the sheet receiving stand 66.

One or the other of the catching members 80 is adapted to be selectively moved by the sheet moving means 82 to three different catching positions, corresponding to three types of sheets with different lengths in the direction of transport, relative to the send-in means 70. Concretely, the catching position of the catching member 80 corresponding to a machine-direction A3 sheet, relative to the send-in means 70, is set to be a machine-direction A3 sheet catching position (machine-direction A3 sheet home position), a posttreatment position at which posttreatment by the stapler 86 is performed. At the machine-direction A3 sheet catching position, the catching member 80 is positioned in the right end portion of the sheet receiving stand 66. The catching position of the catching member 80 corresponding to a machine-direction A4 sheet, relative to the send-in means 70, is set to be a machine-direction A4 sheet catching position (machine-direction A4 sheet home position) on the sheet receiving stand 66, which is a predetermined catching position separated by a predetermined distance from the machine-direction A3 sheet catching position toward the sorting discharge tray 4*c*. The catching position of the catching member 80 corresponding to a cross-direction A4 sheet, relative to the send-in means 70, is set to be a cross-direction A4 sheet catching position (cross-direction A4 sheet home position) on the sheet receiving stand 66, which is another predetermined catching position separated by another predetermined distance, a longer distance than for the machine-direction A4 sheet, from the machine-direction A3 sheet catching position toward the sorting discharge tray 4*c*.

As described above, the catching member 80 is moved in one or the other direction together with the endless belt 85 by the rotational driving of the electric motor. To bring one of the catching members 80 at any of the home positions, the finisher F has three home position sensors S1, S2 and S3 for detecting the home position of the other catching member 80. These sensors S1, S2 and S3 are arranged with spacing in the peripheral direction of the endless belt 85 along a moving path of the endless belt 85 which lies on the side opposite to the side of the moving path of the linear moving portion of the endless belt 85. In this embodiment, the sensor S1 can detect the home position of a machine-direction A3 sheet, the sensor S2 can detect the home position of a machine-direction A4 sheet, and the sensor S3 can detect the home position of a cross-direction A4 sheet. That is, when the sensor S1 detects the other catching member 80, turning ON, the endless belt 85 is stopped at that position. At this time, the one catching member 80 is put to the machine-direction A3 sheet catching position on the sheet receiving stand 66. Similarly, when the sensor S2 detects the other catching member 80, turning ON, the endless belt 85 is stopped at that position. At this time, the one catching member 80 is put to the machine-direction A4 sheet catching position on the sheet receiving stand 66. When the sensor S3 detects the other catching member 80, turning ON, the endless belt 85 is stopped at that position. At this time, the one catching member 80 is put to the cross-direction A4 sheet catching position on the sheet receiving stand 66. In this embodiment, therefore, S1 constitutes a machine-direction A3 sheet home position sensor, S2 constitutes a machine-direction A4 sheet home position sensor, and S3 constitutes a cross-direction A4 sheet home position sensor.

Next, a description will be offered of the actions of the finisher F and the send-in means 70 for the sheet receiving stand 66, e.g., the actions performed when the aforementioned punching mode in double-sided copying is designated. For example, when a sheet size setting key disposed in the operating means of the control means sets the sheet to be a cross-direction A4 sheet, it is judged based on a detection signal from the cross-direction A4 sheet home position sensor S3 whether the catching member 80 has been brought to the cross-direction A4 sheet catching position on the basis of a cross-direction A4 sheet size setting signal. If the cross-direction A4 sheet home position sensor S3 is ON, a judgment is made that the catching member 80 has been brought to the cross-direction A4 sheet catching position. Thus, the sheet moving means 82 is kept at a stopped state. If the sensor S3 is OFF, a judgment is made that the catching member 80 has not been brought to the cross-direction A4 sheet catching position. Thus, the electric motor is driven to make normal rotation. The endless belt 85 is rotationally driven counterclockwise in FIG. 6 to move the catching member 80 in the same direction. When the other catching member 80 is moved to turn the sensor S3 ON, the rotational driving of the electric motor is stopped. As a result, the rotational driving of the endless belt 85 is stopped to bring the catching member 80 to the cross-direction A4 sheet catching position (the cross-direction A4 sheet home position).

The sheet having the image formed on the upward surface thereof during passage through the image forming transport path 10 (i.e., the cross-direction A4 sheet) is punched by a punching means 33 in the same manner as in the previous embodiment. The punched sheet is introduced into the reversing transport path 38, and reversely transported toward the returning path 40. The movable guide member 71 of the send-in means 70 is brought to a first guide position indicated by a solid line in FIG. 6. The sheet introduced into the returning path 40 is returned through the returning path 40 by return roller pairs 52, 54, 56, 58 and 59 such that the directions of the face and back of the sheet are the same as in the image forming transport path 10. In an inverting transport path 60, the sheet is turned upside down and readmitted into the image forming transport path 10. During re-transport of the sheet through the image forming transport path 10, an image is formed on the other surface directed upwards as a result of inversion. The sheet having images formed on both surfaces thereof is transported from the image forming transport path 10 directly toward the returning path 40.

When this sheet is sent into the returning path 40, the movable guide member 71 of the send-in means 70 is moved from the first guide position (the position indicated by a solid line in FIG. 6) to a second guide position (the position indicated by a two-dot chain line in FIG. 6). The cross-direction A4 sheet returned through the returning path 40 is guided to the movable guide member 71 by the return roller pair 52 and conveyed onto the sheet receiving stand 66. During this period, a feed roller 90 is moved from a retreat position to an operating position and also rotationally driven to transport the sheet, conveyed onto the sheet receiving stand 66, toward one of the catching members 80 positioned at the cross-direction A4 sheet catching position (the cross-direction A4 sheet home position) until one end of the sheet arrives at the catching member 80, while pressing the sheet against the surface of the sheet receiving stand 66. When the one end of the sheet reaches the catching member 80, the feed roller 90 is brought from the operating position to the retreat position. After such sheet positioning is carried out relative to the catching member 80 put to the home position on the sheet receiving stand 66, the sheets on the sheet receiving stand 66 are aligned by an aligning means 87 in the same manner as in the previous embodiment.

In the manner described above, the sheets having images formed on both surfaces and punched in one end portion are stored in the punch number in the catching member 80. The electric motor of the sheet moving means 82 is driven for normal rotation to drive the endless belt 85 rotationally counterclockwise. The catching member 80 moves a pile of the sheets toward a sorting discharge roller pair 69. The pile of sheets having images formed on both surfaces and punched in one end portion is discharged onto a sorting discharge tray 4*c* by the sorting discharge roller pair 69. When the catching member 80, which has moved the pile of sheets toward the sorting discharge roller pair 69, is moved to the position of the cross-direction A4 sheet home position sensor S3, the sensor S3 becomes ON to terminate the rotational driving of the electric motor. At the same time, the other catching member 80 is put to the cross-direction A4 sheet catching position. This punching procedure is repeated until the punch set number designated by the punch set number setting key is reached. The piles of sheets are shifted by the aligning means 87 by a predetermined distance toward one edge for alternate sets, such as the 1st set, the 3rd set, the 5th set, and so on, as stated earlier. On the sorting discharge tray 4*c*, the shifted piles of sheets are stored alternately one set at a time.

When a stapling mode in double-sided copying is designated, substantially the same double-sided copying action as the double-sided copying action in the above-described punching mode is performed, except that the order of images produced on the face and back of the same sheet is reversed. The sheet subjected to double-sided copying is fed onto the sheet receiving stand 66 without undergoing punching. When the sheets having images formed on both surfaces are stored by the staple number in the catching member 80 on the sheet receiving stand 66, the electric motor is driven for reverse rotation to drive the endless belt 85 clockwise rotationally. The catching member 80 is moved to a posttreatment position consistent with the machine-direction A3 sheet catching position. When the catching member 80 has been moved to a stapling position, the posttreatment position, the machine-direction A3 sheet home position sensor S1 detects the other catching member 80 to stop the reversed-rotational driving of the electric motor. Thus, the catching member 80 having the pile of sheets stored therein is put to the stapling position. After the aforementioned aligning action by the aligning means 87, the stapler 86 is actuated to staple the sheet pile having the staple number of sheets.

After stapling, the electric motor in the sheet moving means 82 is driven for normal rotation to drive the endless belt 85 rotationally counterclockwise. The catching member 80 moves the stapled pile of sheets toward the sorting discharge roller pair 69. The pile of sheets is discharged onto the sorting discharge tray 4*c* by the sorting discharge roller pair 69. When the catching member 80, which has moved the pile of sheets toward the sorting discharge roller pair 69, is moved to the position of the cross-direction A4 sheet home position sensor S3, the sensor S3 becomes ON to terminate the rotational driving of the electric motor. At the same time, the other catching member 80 is put to the cross-direction A4 sheet catching position. This stapling procedure is repeated until the staple set number designated by the staple set number setting key is reached. The staple set number can be counted such that the stapled pile of sheets moved and discharged onto the sorting discharge tray 4*c* gives the staple set number 1.

The actions in the punching mode and the stapling mode for the cross-direction A4 sheet are carried out in the foregoing manner. The actions for the machine-direction A4 sheet and the machine-direction A3 sheet are also performed in substantially the same manner. The machine-direction A3 sheet catching position (home position) agrees with the stapling position. Thus, after sheets are stored by the staple number in the catching member 80, stapling is performed without the need for the action of moving the catching member 80 to the stapling position.

In the finisher F shown in FIG. 6, only one send-in means, the send-in means 70, is disposed. Besides, sheets can be sent in from one fixed site on the sheet receiving stand 66 (i.e., an end portion facing the sorting discharge tray 4*c*). Thus, the sheets can be sent in onto the sheet receiving stand 66 smoothly and stably. Furthermore, the structure is simple and low in cost. The existing finisher can be put to practical use for the invention with minimal change in its structure.

Moreover, the catching member 80 is provided in the sheet moving means 82, and is adapted to be selectively moved by the sheet moving means 82 to three catching positions (home positions), relative to the send-in means 70, which correspond to plural types of sheets with different lengths in the transport distance (in the embodiment, machine-direction A3 sheet, machine-direction A4 sheet, and cross-direction A4 sheet). Thus, the transport time until a sheet, sent in from the copier body 4, arrives at a predetermined catching position (home position of the catching member 80) on the sheet receiving stand 66 can be made a substantially minimal time adapted for the size of the sheet. This substantially eliminates a loss in the transport time, and increases the transport efficiency. Furthermore, slipping-in of sheets to be accepted by the sheet receiving stand 66 can be reliably prevented, and the pile of transferred sheets arranged in the desired correct order can be formed. Consequently, the reliability of the post-treating action for sheets is improved. If the posttreatment of the sheet is not stapling, but a mere sorting treatment, the time of movement of the sheet by the catching member 80 toward the sorting discharge roller pair 69 can be a minimal time suitable for the size of the sheet. This is of utmost use.

The present invention has been described in detail above with reference to the accompanying drawings based on the embodiments. However, this invention is not restricted to the embodiments, but may be variously modified and changed without departing from the scope of the invention. For example, three types of sheets of JIS A-series sizes (machine-direction A3 sheet, machine-direction A4 sheet, and cross-direction A4 sheet) have been exemplified as usable sheets in the embodiments. Needless to say, there is no reason that the usable sheets are restricted to them. For instance, sheets of various sizes, such as sheets of JIS B-series sizes (machine-direction B4 sheet, machine-direction B5 sheet, and cross-direction B5 sheet) and sheets of inch sizes, can be used. Concretely, when a machine-direction B4 sheet, for example, is used in the embodiment shown in FIG. 5, this sheet is controlled such that it is sent in onto the sheet receiving stand 66 from the send-in means 70, and moved to the catching member 80 by the feed roller 90. When a machine-direction B5 sheet is used, it is controlled to be sent in onto the sheet receiving stand 66 from the send-in means 72. When a cross-direction B5 sheet is used, it is controlled to be sent in onto the sheet receiving stand 66 from the send-in means 74. Then, these sheets are each controlled to be moved to the catching member 80 by the feed roller 90. Even when a sheet of a size expressed in inches is used, suitable control is performed in the above manner in accordance with the type of the size.

Moreover, when a machine-direction B4 sheet, a machine-direction B5 sheet, and a cross-direction B5 sheet, for example, are used in the embodiment shown in FIG. 6, the catching positions of the catching member 80 corresponding to the machine-direction B4 sheet, the machine-direction B5 sheet, and the cross-direction B5 sheet, relative to the send-in means 70, are set at a machine-direction B4 sheet catching position (machine-direction B4 sheet home position), a machine-direction B5 sheet catching position (machine-direction B5 sheet home position) and a cross-direction B5 sheet catching position (cross-direction B5 sheet home position) on the sheet receiving stand 66, which are other predetermined catching positions separated by predetermined distances from the machine-direction A3 sheet catching position toward the sorting discharge tray 4*c*. When a sheet of a size expressed in inches is used, the catching position of the catching member 80 corresponding to the inch-size sheet is set at an inch size sheet catching position (inch size sheet home position) in the above-described manner in accordance with the type of the size. In this manner, the invention can accommodate sheets of various sizes. The invention locating the punching means 33 at a downstream position of the image forming transport path 10 has been described as an embodiment applied to the copier incorporating the finisher, but may be applied to a copier having a finisher attached to one side. In this embodiment, a problem associated with the attachment of the finisher to one side of the copier is present. However, the conventional problem encountered when a sheet having images formed on both surfaces is punched is resolved. In this respect, this embodiment is very useful.

In addition, the embodiment shown in FIG. 6 is constituted such that positional control of the catching member 80 is performed by disposing the home position sensors S1, S2 and S3 in the number corresponding to the types of sizes of sheets used, for the purpose of easy understanding. For practical use, however, it is preferred to carry out the positional control of the catching member 80 by providing only the sensor S1 for detecting the home position of a specific sheet, e.g., the home position of a machine-direction A3 sheet in the embodiment. In this embodiment, the electric motor as the drive source for the driving pulley 83 for the endless belt 85 is composed of a stepping motor (pulse motor), and the position of the catching member 80 is controlled in response to detection signals from the sensor S1, and a drive pulse number produced as a command signal by the control means. Thus, there is no need to provide the home position sensors in the number corresponding to many types of sheet sizes, such as JIS sizes of series A, JIS sizes of series B, and sizes in inches. The provision of only one sensor is enough to perform the above-described positional control accurately, regardless of the number of types of sheet sizes. Thus, the image forming machine of the invention can be put to practical use at a low cost.

What we claim is:

1. An image forming machine having an image forming transport path in which an image is formed on one surface of a sheet being transported, a reversing transport path in which a transport direction of the sheet selectively introduced from a downstream portion of the image forming transport path is reversed, a returning path in which the sheet reversely transported from the reversing transport path is returned below the image forming transport path with the directions of the face and back of the sheet being unchanged, and an inverting transport path in which the sheet returned through the returning path is turned upside down and readmitted into an upstream portion of the image forming transport path, wherein:

a finisher including a sheet receiving stand placed below the returning path is provided, at least one send-in means for selectively sending in the sheet, returned through the returning path, onto the sheet receiving stand is disposed in the returning path, a sorting discharge tray is disposed in a direction of extension of the sheet receiving stand, the finisher has a catching means capable of catching an end of the sheet selectively sent in onto the sheet receiving stand by the send-in means and storing the sheet, a sheet moving means is disposed for moving the sheet caught by the catching means toward the sorting discharge tray, the send-in means is disposed in the returning path at one position in one end portion of the sheet receiving stand facing the sorting discharge tray so that a plurality of types of sheets with different lengths in the direction of transport may be selectively returned, and the plurality of types of sheets with different lengths may be selectively sent in from the one position, and the catching means is selectively moved to a plurality of catching positions, relative to the send-in means, corresponding to the plurality of types of sheets with different lengths.

2. The image forming machine of claim 1, wherein a sheet post-treating means is placed in the other end portion of the sheet receiving stand, a catching position of the catching means corresponding to a sheet having a maximum length in the direction of transport is put to a post-treatment position at which post-treatment by the sheet post-treating means is performed, a catching position of the catching means corresponding to a sheet having a shorter length in the direction of transport than the maximum length in the direction of transport is set to be a predetermined catching position on the sheet receiving stand spaced by a predetermined distance from the post-treatment position toward the sorting discharge tray, and the sheets stored at the predetermined catching position by the catching means are moved to the post-treatment position by the sheet moving means to undergo post-treatment by the sheet post-treating means.

* * * * *